US005986189A

United States Patent [19]

Yang

[11] Patent Number: 5,986,189

[45] Date of Patent: Nov. 16, 1999

[54] MUSIC CARROUSEL STRUCTURE WITH VARIOUS DYNAMIC ACTIONS

[75] Inventor: Shin-Ya Yang, Hsin Tien, Taiwan

[73] Assignee: Ya Yung Enterprise Co., Ltd., Taipei Hsien, Taiwan

[21] Appl. No.: 09/064,650

[22] Filed: Apr. 22, 1998

[51] Int. Cl.[6] ..... G10F 1/06

[52] U.S. Cl. ..... 84/95.2; 40/415; 446/238; 472/12

[58] Field of Search ..... 84/95.1, 95.2, 84/94.1, 94.2; 40/411, 414, 415; 446/237, 238, 241, 244, 245; 472/12, 29, 43

[56] References Cited

U.S. PATENT DOCUMENTS

| | | | |
|---|---|---|---|
| 2,910,295 | 10/1959 | Dietze | 272/31 |
| 3,191,930 | 6/1965 | Cottrell et al. | 272/31 |
| 4,925,182 | 5/1990 | Hou | 272/31 R |
| 5,179,796 | 1/1993 | Gephart, Jr. | 40/473 |
| 5,203,743 | 4/1993 | Hou et al. | 472/2 |
| 5,276,271 | 1/1994 | Huang et al. | 84/94.2 |
| 5,555,656 | 9/1996 | Liu | 40/411 |
| 5,556,318 | 9/1996 | So | 446/236 |
| 5,571,979 | 11/1996 | Chen | 84/95.2 |
| 5,617,658 | 4/1997 | Chen | 40/411 |
| 5,721,388 | 2/1998 | Shih | 84/95.2 |
| 5,875,577 | 3/1999 | Lu | 40/411 |

*Primary Examiner*—Robert E. Nappi
*Assistant Examiner*—Wesley Scott Ashton
*Attorney, Agent, or Firm*—Pro-Techtor International Services

[57] ABSTRACT

A music carrousel structure with various dynamic actions, including several decorative articles, a stem and a base. The power mechanism of the music box is fixed on a support tray. The power output shaft is engaged with a gear which is engaged with a toothed ring. The center of the toothed ring is disposed with a central disc which is on the same plane as the lower surface of the toothed ring. The above members are all hidden in a canopy. The canopy is fixed with a fixing disc or a hanging disc. The toy horses via copper rods are hung on outer periphery of the toothed ring or the support tray. The canopy is supported on the support rod. A stem in the support rod is connected with a transmission mechanism in the base, whereby the power is transmitted to the transmission mechanism. The decorative articles are fixed on the transverse levers and get into and out of the holes of the base by means of cooperation of the springs and waved block.

8 Claims, 7 Drawing Sheets

MUSIC CARROUSEL STRUCTURE WITH VARIOUS DYNAMIC ACTIONS

BACKGROUND OF THE INVENTION

The present invention relates to a music carrousel structure with various dynamic actions. The music carrousel structure can be easily and conveniently operated.

Many kinds of decorative music carrousels are commercially available. These decorative carrousels can be substantially divided into two types. One is that the carrousel has monotonous action which can hardly meet the requirement of market. The other is that the decorative toy horses can be lifted and lowered. However, such carrousel has complicated structure and a lot of parts and is subject to mechanical malfunction. Moreover, it is inconvenient to operate such carrousel and the manufacturing cost for such carrousel is very high.

SUMMARY OF THE INVENTION

It is therefore a primary object of the present invention to provide a music carrousel structure with various dynamic actions, which has simple structure and can be easily operated. The music box is hidden in the canopy. An output shaft of the rotary cylinder of the music box is connected with a gear which extends through a rectangular or arch slot to mesh with a toothed ring. By means of an assisting mechanism, various vivid dynamic actions are created. When the canopy is rotated, the canopy and the inner and outer layers of hanging horses will revolve and asynchronously chase in the same direction or the canopy and the hanging horses will revolve in reverse directions. Alternatively, when revolving, the hanging horses can ascend and descend. Moreover, the decorative articles can get into and out of the holes of the base.

The present invention can be best understood through the following description and accompanying drawings, wherein:

DETAILED DESCRIPTION OF THE PREFERRED EMBODIMENTS

Figure 1:
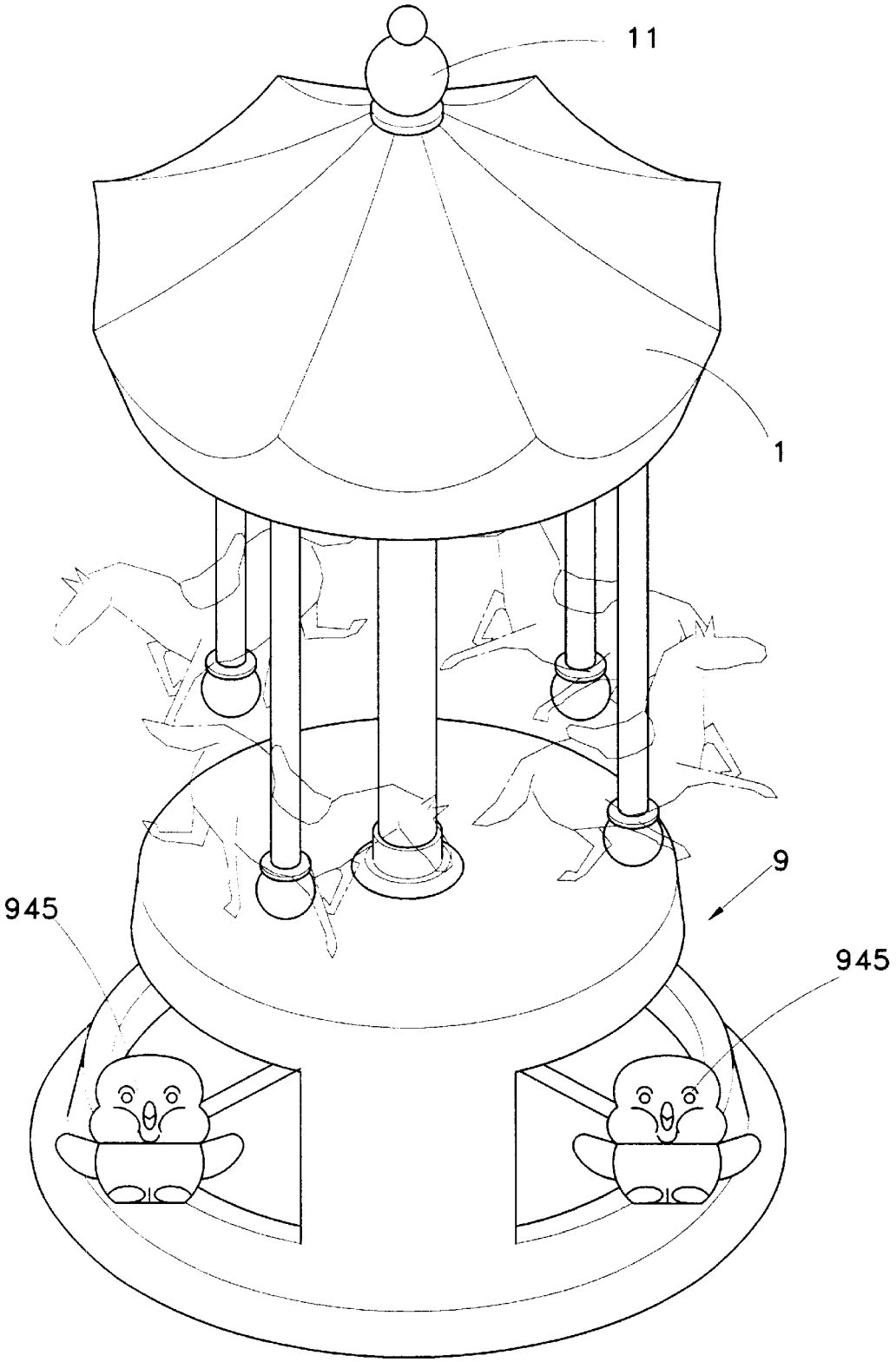
FIG. 1 is a perpective assembled view of the present invention, showing that the canopy and hanging horses revolve and the decorative articles get into and out of the holes of the base.
Figure 2:
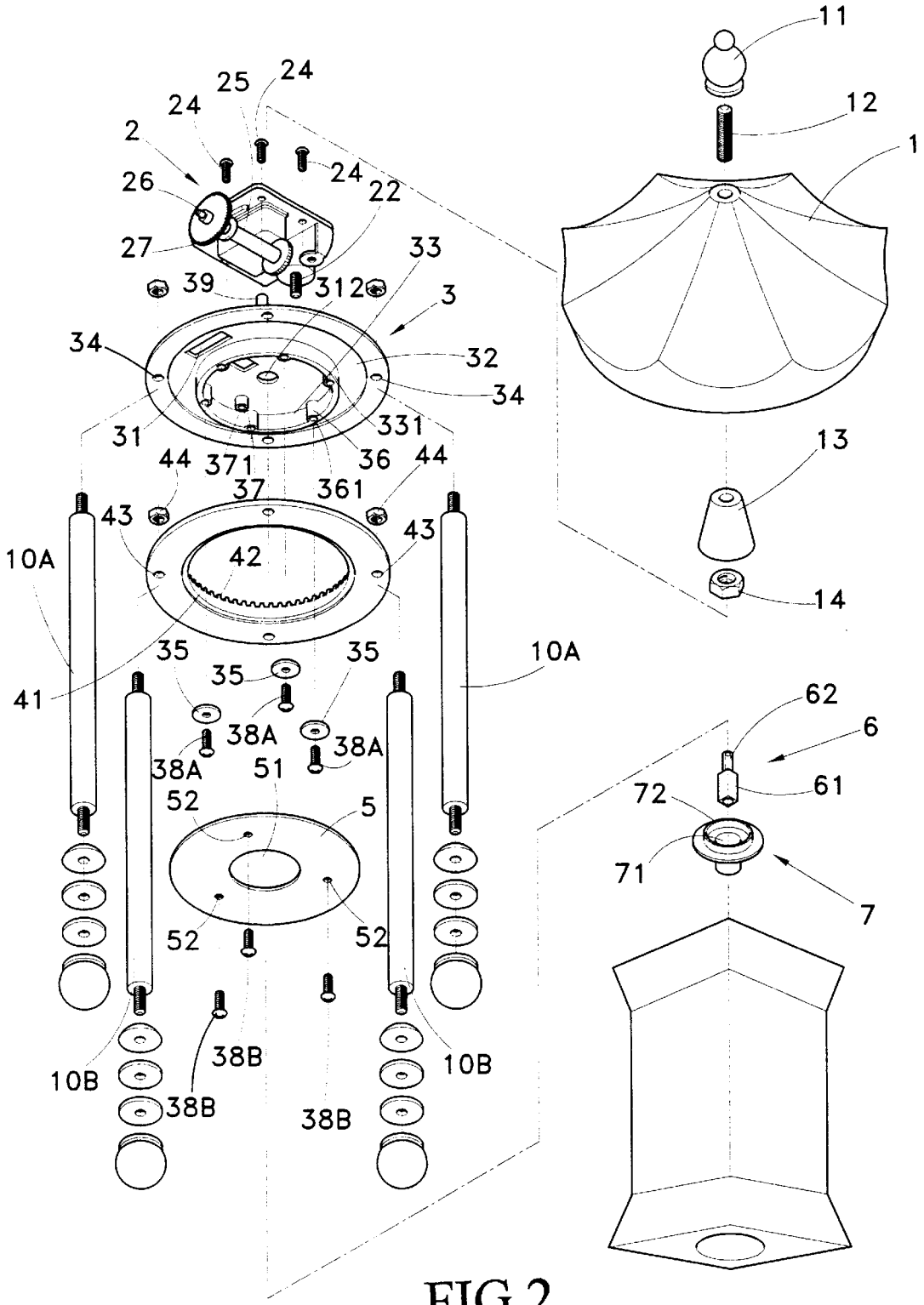
FIG. 2 is a perspective exploded view of the present invention, in which the inner and outer layers of hanging horses will asynchronously revolve in the same direction.
Figure 3:
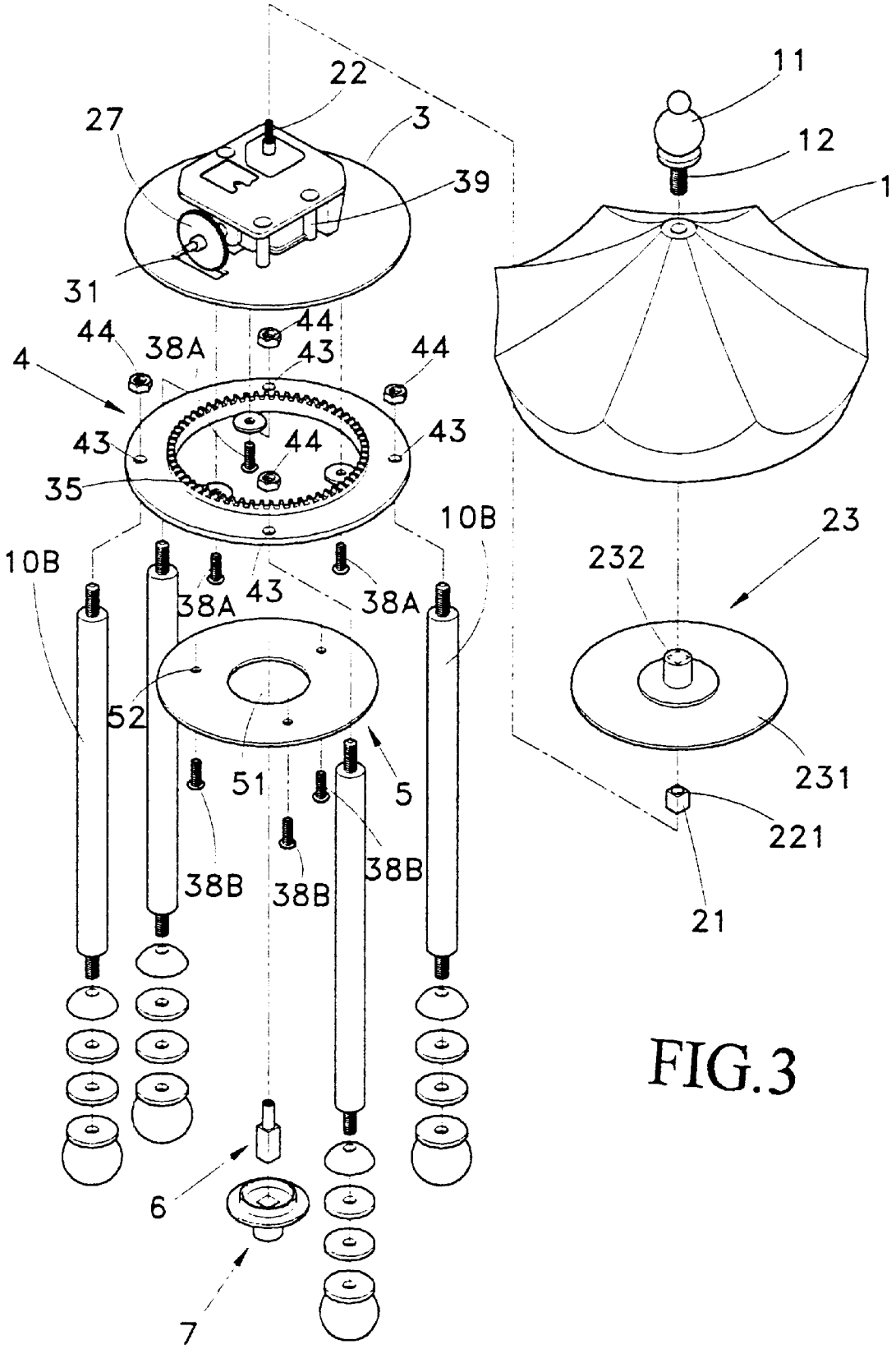
FIG. 3 is a perspective exploded view of the present invention, in which the canopy and the hanging horses will revolve in reverse directions.

Please refer to FIGS. 1 and 2. The present invention includes a canopy 1 and a copper dome 11 at the top of the canopy 1. A thread rod 12 is passed through the top of the canopy 1 into the dome 11. The thread rod 12 is tightened by a pad plug 13 and a nut 14 so as to fixedly connect the dome 11 with the canopy 1. The driving mechanism of the present invention is hidden in the canopy 1. Referring to FIG. 3, a plastic fixing disc 3 has three slender vertical posts 39 on upper face. Small screws 24 fix a music bell on the posts 39 of the fixing disc 3 in a reverse state. The outer periphery of the fixing disc 3 is formed with several equally spaced holes 34 for fixedly passing therethrough copper rods 10A of the outer hanging toy horses. A pinion 27 is connected with an outer end of the output shaft 26 of a music rotary cylinder 25. A bottom end of the pinion 27 protrudes through a rectangular or arch slot 31 of the fixing seat. The protruding section of the pinion 27 meshes with the teeth 42 of a toothed ring 4. The periphery of the toothed ring 4 is also formed with several equally spaced holes 43 for fixing the inner hanging toy horses and the copper rods 10B thereof. The number of teeth and diameter of the pinion 27 differ from the number of teeth and diameter of the toothed ring 42 so that the inner and outer hanging toy horses revolve at different speeds. The lower face of the fixing disc 3 has an outer ring 32 for reinforcing the fixing disc 3 and an inner ring 33 having an outer end face 331 for circumferentially locating the toothed ring 4. Therefore, the toothed ring 4 can smoothly revolve about the fixed central shaft 6. The inner wall of the inner ring of the fixing disc 3 has six equally spaced semicircular columns 36 each formed with a small hole 361 for a screw 38A to connect a small circular copper plate 35 with the column 36. The small copper plate 35 is formed with a central hole 351 in which the root section of the screw 38A is fitted. Therefore, the small copper plate 35 can revolve about the root section of the screw 38A. The periphery 352 of the copper plate 35 retains the inner side 41 of the toothed ring 4 so as to restrict the axial vertical travel of the toothed ring 4. According to the above arrangement, the power is output from the output shaft 26 of the music rotary cylinder to drive the pinion 27. The pinion 27 through the slot 31 meshes with the teeth 42 of the toothed ring 4 so as to drive the toothed ring 4 to rotate. Therefore, the inner side 41 of the toothed ring 4 will frictionally contact with the lateral side 352 of the copper plate. In the case of relatively small frictional force, the inner side 41 will slide over the copper plates 35. However, in the case of relatively large frictional force, the inner side 41 will drive the copper plate 35 to revolve about the screw 38A. This enables the toothed ring 4 to smoothly revolve. The copper rods 10B of the inner hanging toy horses are passed through the peripheral holes 43 of the toothed ring and the nut 44 to connect with the toothed ring 4, so that the movement of the toothed ring 4 will lead to corresponding movement of the inner hanging toy horses. The lower face of the fixing seat 3 is disposed with three equally spaced posts 37 each having a small hole 371. Screws 38B pass through three small holes 52 to fix a central disc 5 on the fixing seat 3. At this time, the semicircular columns 36 and circular copper plates 35 and screws 38A are covered by the central disc 5 and the bottom face of the central disc 5 serves as a plane retaining face for connecting with a support seat 7. A winding shaft 22 of the music box is passed through the central hole 312 of the fixing seat 3 and the central hole 51 of the central disc 5. The thread section at lower end of the winding shaft 22 is engaged with the thread hole 62 of upper end of the central transmission shaft 6 as shown in FIG. 2. The lower end of the central transmission shaft 6 has a rectangular column 61 for tightly fitting into a rectangular hole 71 of the support seat 7, whereby the canopy and the internal driving mechanism are stably located at the central position. The canopy 1, music box 2, fixing seat 3 and central disc 4 are assembled as an integral body which revolves relative to the rectangular shaft 6. In this procedure, the winding spring 22 of the music box also conserve resilient energy. The entire canopy structure is stably supported by the support point 72 of the support seat 7 as shown in FIG. 2.

Figure 4:
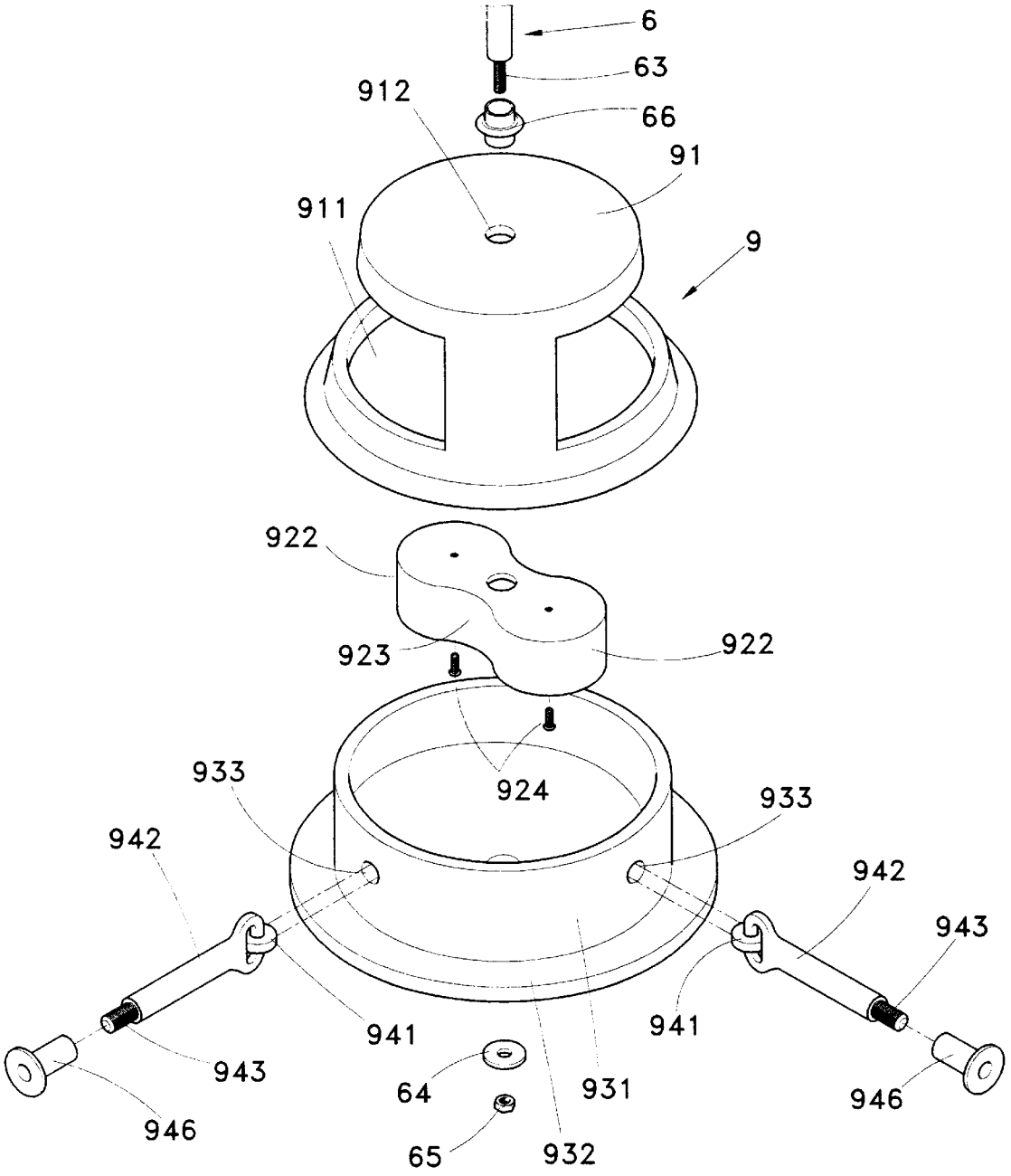
FIG. 4 is a perspective exploded view of the present invention, in which the decorative articles will get into and out of the holes of the base.

FIG. 3 shows another embodiment of the present invention. In this embodiment, the canopy 1 is fixedly attached to the periphery 231 of the hanging disc 23. The hanging disc 23 has a central rectangular hole 232 for tightly fitting into a rectangular short shaft 21. The inner thread 221 of the short shaft 21 is screwed with the outer thread of the winding shaft 22 of the music bell. The toy horses are equally spacedly arranged along the outer periphery of the toothed ring 4. According to such modification, after the canopy is clockwise rotated, the four hanging horses will revolve in a direction reverse to the canopy 1 to create another aspect of action. In this embodiment, the contacting faces of the central disc 5 and the support seat 7 are fixedly connected to each other without relative sliding. This is different from FIG. 2 in that the outer periphery of the fixing seat 3 is not fixedly connected with the hanging horses. As shown in FIG. 4, the central shaft 6 is replaced by an elongated shaft. The thread hole of upper end of the elongated shaft is screwed with the end of the winding shaft 22. The lower end of the elongated shaft is passed through the central passage 912 of the top of the base 9 and extended to the interior of the base 9. Via a pad member 64, a nut 65 firmly tightens a base support tray 932 on a stem 6A. A copper sleeve 66 is disposed at the passage of the top of the base to reinforce and stabilize the stem 6A, enabling the same to smoothly rotate. Via a pad member 67 and a nut 68, the copper sleeve 66 is fixed on an upper layer 91 of the base. Accordingly, the central stem 6A is able to stably rotate within the copper sleeve 66 as shown in FIG. 4.

The above structure can be modified. For example, the lateral side of the base can be formed with several holes in which a transmission mechanism and decorative articles are disposed. Accordingly, a dynamic aspect can be created that the decorative articles can get in and out of the holes. This will be described in detail hereinbelow.

FIG. 4 shows the structure of the base. The support tray 932 is integrally connected with the annular wall 931 formed with several holes 933. The copper sleeve 946 is received in the hole 933. The slide rod 942 is slidably fitted in the copper sleeve 946. An inner end of the slide rod 942 is provided with a spherical flange 941. The spring 943 is fitted between the spherical flange 941 and the copper sleeve 946. A waved block 92 is fixed by screws 924 on a top layer 91 of the base 9. The waved block 92 has several convex faces 922 and several concave faces 923. When the stem 6A drives the base 9 to rotate, the flange 941 will slide over the concave and convex faces of the waved block 92. When the flange 941 is contacted by the convex face 922 of the waved block 92, the spring 943 fitted around the slide rod is compressed and the slide rod is pushed out. At this time, the decorative article 945 connected with the other end of the slide rod can go out of the hole 911. When the spherical flange 941' is contacted by the concave face 923 of the waved block 92, the spring 943 on the slide rod is extended and the decorative article 945 is slowly retracted into the hole 911 and hidden in the base. When the spherical flange 941 further slowly slides to another convex face 922 of the waved block 92, the decorative article 945 again slowly goes out of another hole 911 corresponding to the other convex face 922. Therefore, under cooperation between the spring 943 and the waved block 92, the decorative article 945 continuously goes into and out of holes in the base 9 following the rotation of the support tray. The wave amplitude of the concave and convex faces of the waved block 92 is equal to the extension distance of the slide rod getting into and out of the holes. Also, the depth of the holes of the base and the distance between the hole and the support tray and the length of the slide rod are determined by the above amplitude. Therefore, it is ensured that the decorative article can smoothly get into and out of the holes without touching the base. Accordingly, a vivid and funny action is created by the carrousel in which the canopy is stably rotated and the hanging horses reversely revolve and the decorative articles 945 continuously go into and out of the holes of the base. Moreover, during reverse revolving of the canopy and the hanging horses, the hanging horses will ascend and descend.

Figure 5:
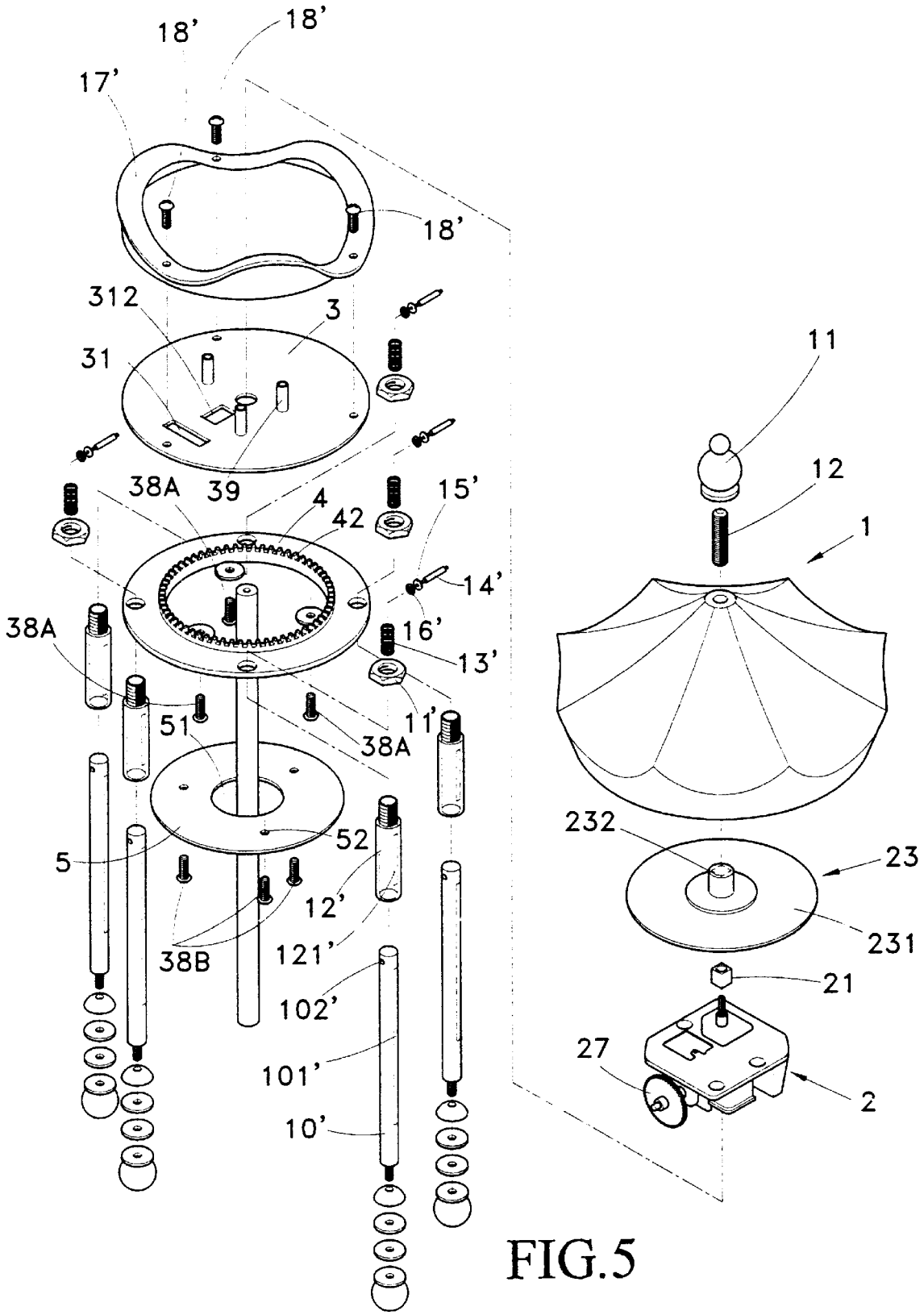
FIG. 5 is a perspective exploded view of the present invention, in which when the canopy and the hanging horses revolve, the hanging horses will ascend and descend.
Figure 6:
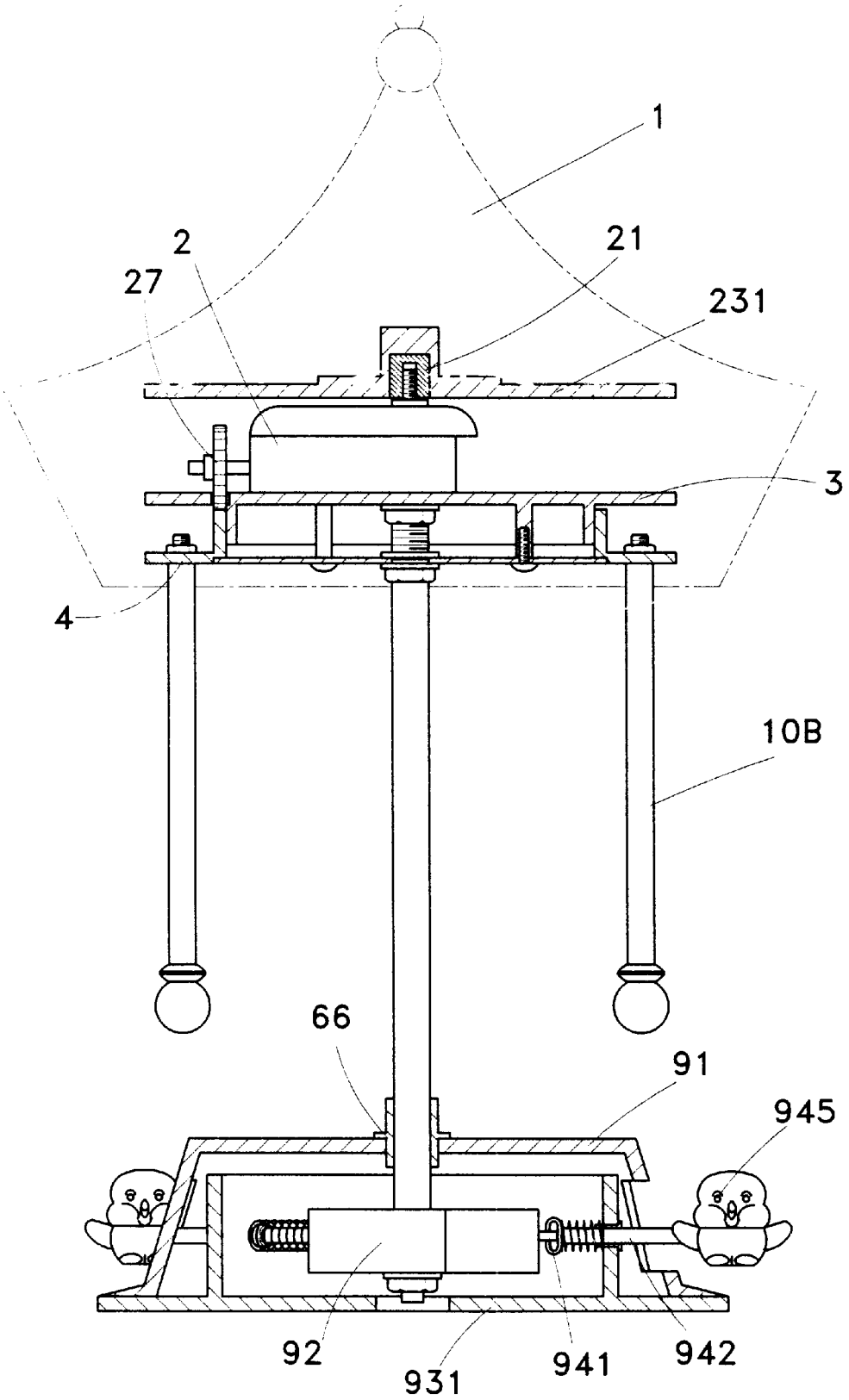
FIG. 6 is a sectional view of the present invention.
Figure 7:
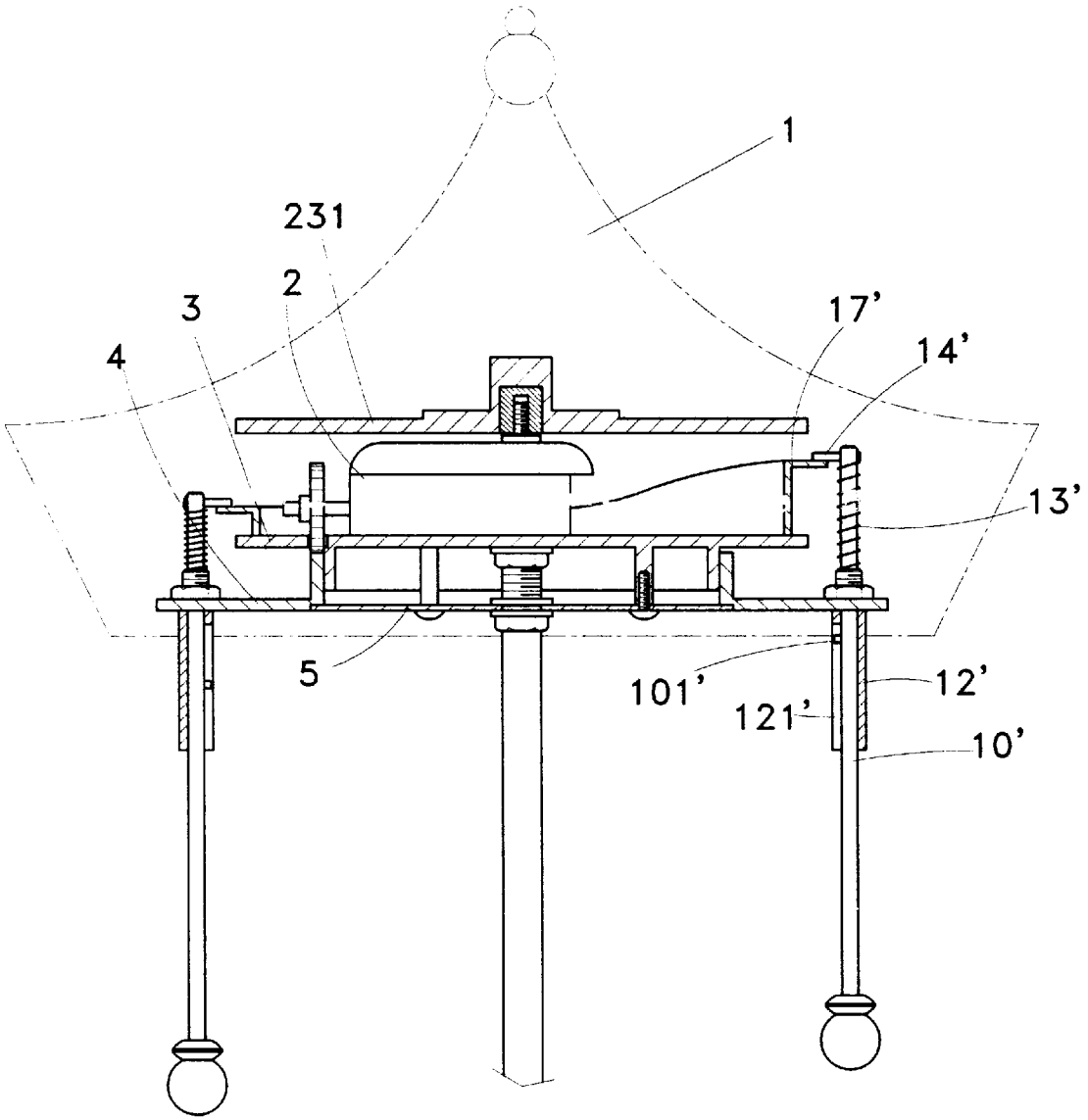
FIG. 7 is a sectional view of the upper portion of the present invention.

Referring to FIGS. 5–7, the copper rod 10' is fitted in the copper sleeve 12' which is fixed by a nut 11' on the periphery of the toothed ring 4. A spring 13' is fitted around upper section of the copper rod 10'. The copper rod 10' is slidably fitted in the copper sleeve 12'. The upper end of the copper rod 10' through a thread hole 102' is fixedly connected with a horizontal lever 14'. The other end of the horizontal lever 14' is connected with a small wheel 15' having a central hole. An outer end of the small wheel is disposed with a restricting spring 16' for restricting the axial travel of the small wheel 15'. The small wheel 15' is rotatably about the axis of the horizontal lever 14'. The fixing disc 3 has a waved annular rail 17' locked on the fixing disc 3 by screws 18'. When the fixing disc 3 is moved relative to the toothed ring 4, the small wheel 15' smoothly rolls on the annular rail 17' through the horizontal lever 14' to drive the copper rod 10' to move up and down. Therefore, the hanging horse fixed on the copper rod 10' can simultaneously move up and down when running. The moving amplitude is determined by the wave amplitude of the annular rail 17'. The spring 13' not only provides a buffering effect, but also assists in changing direction during ascending and descending of the copper rod 10'. The copper rod 10' is formed with a key slots 101' for slidably receiving the projecting block 121' of the slide sleeve 12'. Such structure restricts the copper rod 10' from swinging or rotating and only permitting the copper rod 10' to vertically slide along the slide sleeve. In addition, in the case that the outer hanging horses are integrally connected with the canopy and the inner hanging horses are integrally connected with the toothed ring, another aspect of action will be created. That is, the outer and inner hanging horses will revolve in reverse directions and will ascend and descend.

According to the above arrangements, the present invention has the following features:

1. The music box serves as the power source and is placed in the canopy. The output shaft of the music rotary cylinder is connected with a pinion meshing with a toothed ring for transmitting the power to the hanging horses. The music box can be right placed or reversely placed on the fixing seat. The driving mechanism can be connected to the periphery of the fixing seat or on the hanging disc. The hanging horses under the canopy can have one layer or multiple layers. The hanging horses and the canopy are fixed at different positions. By means of different assemblies, different aspects of dynamic actions can be created. The canopy enclosing the power source is manually driven so as to revole the canopy and the hanging horses in the same direction or in reverse directions. Therefore, the hanging horses will chase each other or run through each other.
2. The present invention employs very simple structure in which the music bell is right or reversely placed on the fixing seat and the hanging horses are equally spaced and fixed on the periphery of the toothed ring. Alternatively, the hanging horses are divided into inner and outer layers respectively fixed on the peripheries of the fixing seat and the toothed ring. The inner and outer hanging horses are positioned on the same plane with the central disc serving as a central support face. The entire driving mechanism is hidden in the canopy. The rotary axis of the entire mechanism is coaxial with the winding shaft of the music box. The driving mechanism is able to provide different rotational directions or speeds. Such structure can be easily manufactured and assembled.

3. Assisting mechanism and driven members are added to the basic structure for easily connecting the driving mechanism with the base. A waved annular ring is added to the support tray for ascending/descending the hanging horses when revolving about the shaft.

It is to be understood that the above description and drawings are only used for illustrating some embodiments of the present invention, not intended to limit the scope thereof. Any variation and derivation from the above description and drawings should be included in the scope of the present invention.

What is claimed is:

1. A music carrousel structure with various dynamic actions, comprising:

a fixing seat having a plurality of posts on an upper surface for fixing a music box, the fixing seat being formed with a slot through which a pinion of the music box extends to mesh with a toothed ring, a bottom face of the fixing seat being formed with a ring section, an outer side of the ring section serving to circumferentially locate the toothed ring, an inner side of the ring section being disposed with a plurality of columns, a middle portion of the bottom face being disposed with a plurality of posts, the fixing seat being formed with a central hole through which a winding shaft of the music box is passed;

a toothed ring having annularly arranged teeth for meshing with the pinion for transmitting power, an outer periphery of the toothed ring being formed with several holes, copper rods being fitted into the holes and tightened by nuts, decorative articles being affixed to the copper rods, the toothed ring being formed with a large central circular hole, a vertical surrounding wall of the circular hole and lateral side of the bottom face respectively serving as circumferential and axial support points;

small circular copper plates each having a central hole and a smooth surface, said copper plates being secured to the fixing seat for restricting a vertical movement of the toothed ring;

a central disc having a central hole, serving as a planar fixing face for connecting to the bottom face of the fixing seat;

a central transmission shaft with one end engaged with the music box and the other end inserted and fixed in a central hole of a support seat, and a hanging disc having a central hole for connecting with a protruding end of the winding shaft of the music box, the hanging disc being positioned above the music box, the periphery of the hanging disc being connected with a canopy.

2. A music carrousel structure as claimed in claim 1, wherein: the winding shaft, toothed ring, hanging disc, support seat and canopy are all coaxially arranged.

3. A music carrousel structure as claimed in claim 1, wherein:

the canopy is fixed on the hanging disc or the fixing seat and the music box is placed on the fixing seat.

4. A music carrousel structure as claimed in claim 1, wherein:

at least one sleeve is fixed on the periphery of the toothed ring for guiding vertical movement, the sleeve being formed with an inward projecting slide key for restricting the sleeve from swinging;

a copper rod with a thread hole at a top end and a slide slot in a surface thereof for slidably receiving the slide key of the sleeve, whereby the copper rod can only vertically slide within the sleeve without rotation;

a transverse lever, a first end of which is threaded to the thread hole of the copper rod and a second end of which is passed through an engaging spring to connect with a small wheel, the engaging spring serving to restrict the small wheel from axially moving;

the small wheel having a smooth surface and being rotatable about the transverse lever;

the engaging spring is fitted around the copper rod between the copper sleeve and the transverse lever to provide a buffering effect and to assist in changing direction; and a waved annular rail with a smooth surface fixed on the fixing disc upon which the transverse lever is disposed and moves.

5. A music ca el structure as claimed in claim 4, wherein:

the waved annular rail is fixed on the fixing disc and both the waved annular rail and the fixing disc are hidden in the canopy.

6. A music carrousel structure as claimed in claim 1, wherein:

a transmission mechanism in a base is connected with the central transmission shaft, the transmission mechanism including:

a waved block fixed by screws on the top of the base and having contoured faces;

a support tray and an annular wall fixed on the support tray, the annular wall being formed with several holes in which slide sleeves are fixed;

slide rods horizontally slidably fitted in the slide sleeves, an inner end of the slide rod having a spherical flange, an outer end of the slide rod being connected with a decorative article, a spring being fitted between the slide sleeve and the spherical flange;

slide sleeves fixed in the holes of the annular wall to ensure that the slide rods stably horizontally slide therein; and a spherical flange fixed on the slide rod to slidably contact with the contoured faces of the waved block.

7. A music carrousel structure as claimed in claim 6, wherein: the base is formed with several holes.

8. A music carrousel structure with various dynamic actions, comprising:

a fixing seat having a plurality of posts on an upper surface for fixing a music box, the fixing seat being formed with a slot through which a pinion of the music box extends to mesh with a toothed ring, a bottom face of the fixing seat being formed with a ring section, an outer side of the ring section serving to circumferentially locate the toothed ring, an inner side of the ring section being disposed with a plurality of columns, a middle portion of the bottom face being disposed with a plurality of posts, the fixing seat being formed with a central hole through which a winding shaft of the music box is passed;

a toothed ring having annularly arranged teeth for meshing with the pinion for transmitting power, an outer periphery of the toothed ring being formed with several holes, copper rods being fitted into the holes and tightened by nuts, decorative articles being affixed to the copper rods, the toothed ring being formed with a large central circular hole, a vertical surrounding wall of the circular hole and lateral side of the bottom face respectively serving as circumferential and axial support points;

small circular copper plates each having a central hole and a smooth surface, said copper plates being secured to the fixing seat for restricting a vertical movement of the toothed ring;

a central disc having a central hole, serving as a planar fixing face for connecting to the bottom face of the fixing seat;

a central transmission shaft with one end engaged with the music box and the other end inserted and fixed in a central passage of a base; and a hanging disc having a central hole for connecting with a protruding end of the winding shaft of the music box, the hanging disc being positioned above the music box, the periphery of the hanging disc being connected with a canopy; and wherein a waved block is driven by the central transmission shaft extending out of the canopy into the base.

* * * * *